US005090687A

United States Patent [19]

Maier et al.

[11] Patent Number: 5,090,687

[45] Date of Patent: Feb. 25, 1992

[54] METHOD OF SORTING PRINTING PLATES

[75] Inventors: Willy Maier, Kloten; Thomas Bachmann, Zurich, both of Switzerland

[73] Assignee: Daverio AG, Zurich, Switzerland

[21] Appl. No.: 630,486

[22] Filed: Dec. 20, 1990

Related U.S. Application Data

[62] Division of Ser. No. 347,150, May 3, 1989, Pat. No. 5,011,131.

[30] Foreign Application Priority Data

Jul. 11, 1988 [CH] Switzerland ..... 2641/88

[51] Int. Cl.[5] ..... B65H 39/06

[52] U.S. Cl. ..... 271/289; 271/293; 271/296; 271/303; 270/58; 414/268; 414/276; 414/786

[58] Field of Search ..... 414/267, 273, 276, 277, 414/281, 283, 285, 786, 787; 198/364; 270/58; 271/287, 288, 289, 293, 296, 298, 303

[56] References Cited

U.S. PATENT DOCUMENTS

| | | | |
|---|---|---|---|
| 3,372,922 | 3/1968 | Snellman | 271/296 |
| 3,561,753 | 2/1971 | Snellman | 271/296 X |
| 3,604,321 | 9/1971 | Snellman | 271/296 X |
| 3,765,670 | 10/1973 | Johnson | 271/296 |
| 3,774,902 | 11/1973 | Schulze | 271/293 |
| 4,111,410 | 9/1978 | Tates et al. | 271/293 X |
| 4,162,787 | 7/1979 | Shirahase et al. | 271/293 |
| 4,216,955 | 8/1980 | Auritt et al. | 271/296 |
| 4,315,621 | 2/1982 | Snellman | 198/364 X |
| 4,469,323 | 9/1984 | Miyashita et al. | 271/296 X |
| 4,478,406 | 10/1984 | DuBois | 271/293 |
| 4,494,748 | 1/1985 | Miyashita et al. | 271/298 X |
| 4,498,665 | 2/1985 | Watanabe | 271/296 X |
| 4,647,034 | 3/1987 | Sawa | 271/293 |
| 4,671,505 | 6/1987 | Hidaka | 271/293 |
| 4,836,529 | 6/1989 | Kosaka et al. | 271/303 X |
| 4,842,264 | 6/1989 | Kosaka et al. | 271/296 X |
| 4,843,434 | 6/1989 | Lawrence et al. | 271/296 X |

FOREIGN PATENT DOCUMENTS

| | | | |
|---|---|---|---|
| 55-93764 | 7/1980 | Japan | 271/289 |
| 56-165661 | 12/1981 | Japan | 271/293 |
| 57-156964 | 9/1982 | Japan | 271/287 |
| 58-47757 | 3/1983 | Japan | 271/287 |
| 58-188266 | 11/1983 | Japan | 271/287 |
| 59-86553 | 5/1984 | Japan | 271/293 |
| 59-128161 | 7/1984 | Japan | 271/293 |
| 62-83981 | 4/1987 | Japan | 271/287 |

*Primary Examiner*—David A. Bucci
*Assistant Examiner*—Robert S. Katz
*Attorney, Agent, or Firm*—Weiser & Stapler

[57] ABSTRACT

A sorting device includes a plurality of shelves placed one above the other in a frame, each adapted to receive a printing plate in sorted fashion. Located in front of the insertion opening of the shelves is a transport device for moving the printing plates along the shelves, preferably from top to bottom. Between the transport device and the shelves is a sorting carriage which can travel along the shelves and which includes a pivotable flap which operates to deflect the printing plates from the transport device to a desired shelf. To allow the printing plates to be introduced into the shelves, while keeping the shelves placed close together, the shelves are pivotally mounted at their lower edges and the sorting carriage is provided with a tappet for engaging the shelf located above the selected shelf, to lift the upper shelves and thereby enlarge the insertion opening. The arrangement is especially suitable for sorting so-called "flexoplates" and flexible offset plates.

7 Claims, 4 Drawing Sheets

METHOD OF SORTING PRINTING PLATES

This is a division of application Ser. No. 347,150 filed May 3, 1989, now U.S. Pat. No. 5,011,131.

BACKGROUND OF THE INVENTION

The present invention relates generally to sorting devices, and more particularly, to an apparatus for sorting printing plates, especially flexible printing plates.

Although the sorting apparatus of the present invention will find utility in other applications, the disclosed sorting apparatus is primarily intended for use in conjunction with printing plate transporting systems of the type disclosed in copending U.S. Pat. application Ser. No.07/333,050 filed Apr. 3, 1989, and entitled "APPARATUS FOR CONVEYING PRINTING PLATES" The disclosed plate transporting system operates to transport printing plates from the machine which produces the plates to the plate folding unit which is located in the rotary press area. To this end, the printing plates are conveyed to an unloading station, suspended from a conveyor member guided along a rail, and then delivered to a collecting bin. Primarily, the printing plates are flexible printing plates, or so-called "flexo-plates", which are very delicate and which must be carefully handled. However, the printing plates can also be offset plates, if desired. The transport and sorting of other flat products is also made possible using such a system.

The need therefore arose to develop a versatile sorting device for us in conjunction with automated systems of this general type.

SUMMARY OF THE INVENTION

It is therefore the primary object of the present invention to provide a sorting device for operating in conjunction with automated systems such as those which are used to process flexible printing plates and the like.

It is also an object of the present invention to provide a sorting device which is adapted to automatically handle a large number (e.g., forty or more) of printing plates, with a high degree of reliability.

It is also an object of the present invention to provide a sorting device which can automatically and reliably distribute a plurality of individually sorted plates, for eventual removal as needed.

It is also an object of the present invention to provide a sorting device having the foregoing capabilities, yet which occupies comparatively little space.

It is also an object of the present invention to provide a sorting device having the foregoing capabilities, yet which prevents damage to delicate printing plates.

These and other objects are achieved in accordance with the present invention by providing a sorting device having a frame which includes a plurality of shelves for receiving the printing plates; a transport device for moving the printing plates along the shelves, and which is located in front of the insertion openings for the shelves; and at least one sorting carriage placed between the shelves and the transport device, which can be moved in controllable fashion along the shelves responsive to control means which further operate to selectively divert printing plates from the transport device to the shelves which are to be filled.

Using such an apparatus, printing plates delivered to the sorting device can be deposited into a series of vertically arrayed shelves, from top to bottom. As a result of the continuous movement of the transport device, the plates being handled need not stop along their delivery path, resulting in a very rapid filling of the shelves. What is more, the shelves can be filled in any sequence (e.g., the topmost empty shelf can be filled in each case), and the delivery path of the printing plates can be kept optimally short. If desired, two or more printing plates can be deposited in one shelf, doubling the number of printing plates that can be stored.

The transport device provided for conveying the printing plates preferably has at least one guide rail with vacuum openings, against which the continuously moving printing plates can be drawn by vacuum. This allows for a particularly gentle treatment of the printing plates, as well as reliable filling of the shelves. The distance between the trays is made optimally short by providing the sorting carriage with means for lifting the shelves located above the shelf which is to be filled, thereby enlarging the insertion opening which results.

For further detail regarding a preferred embodiment sorting apparatus in accordance with the present invention, reference is made to the detailed description which is provided below, taken in conjunction with the following illustrations.

BRIEF DESCRIPTION OF THE DRAWINGS

In the several views provided, like reference numbers denote similar structures.

DETAILED DESCRIPTION OF THE PREFERRED EMBODIMENTS

Figure 1A:
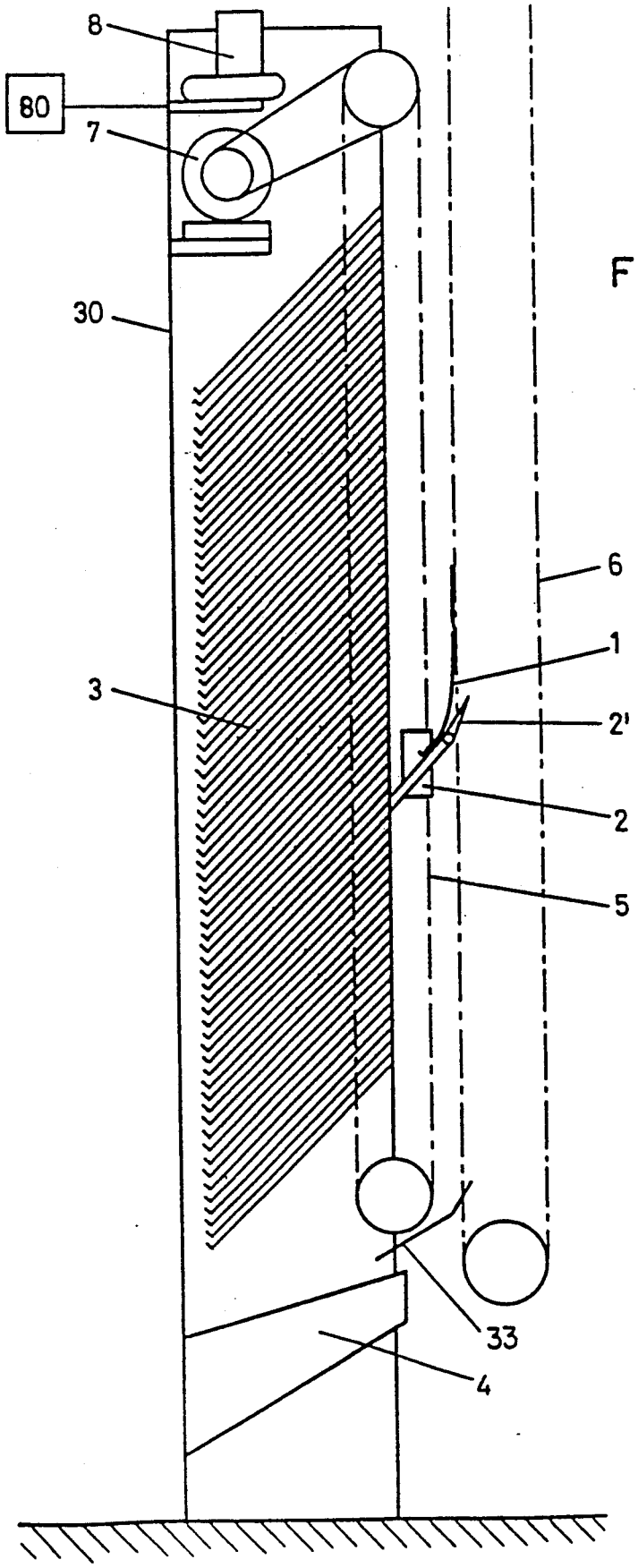
FIG. 1*a* is a schematic, side elevational view of the sorting device.

The sorting device generally takes the form of a frame 30 having a plurality of trays or shelves 3, which are placed one above the other, and which are inclined and generally parallel to one another. Each shelf 3 is accessible from above through an insertion opening 31, and can be emptied from below through an extraction opening 32. The distance between adjacent shelves 3 is selected so that at least one printing plate 1 can be deposited between them. The printing plates 1 are moved from top to bottom along the openings 31 by means of a transport device 6 (generally comprised of a drive element responsive to an appropriate motor) as will be explained in more detail below.

Located between the shelves 3 and the transport device 6 is at least one sorting carriage 2, which can be moved upward and downward by a drive element 5 responsive to a motor 7. The sorting carriage 2 is thus made movable to a desired shelf 3 responsive to an appropriate control device 80. If a relatively large number of shelves 3 are provided (e.g., forty-five shelves 3), it is preferable to provide several sorting carriages 2 at spaced intervals along the drive element 5. For example, three such sorting carriages 70 are provided in the alternative embodiment illustrated in FIG. 4. In such case, the sorting carriages 70 are preferably maintained at fixed distances relative to one another, so that each sorting carriage can serve a number of shelves 56 (e.g., the topmost sorting carriage serves the upper fifteen shelves, the second sorting carriage serves the next fifteen shelves, and the third sorting carriage serves the lowest fifteen shelves). This is possible with both exemplary embodiments.

The sorting carriage 2 is equipped with a flap 2', which can be moved into two positions. In one position (shown in FIG. 1*a*), a printing plate 1 moving from top to bottom is separated from the transport device 6 and guided into the selected shelf 3. As is best illustrated in FIG. 1*b*, the printing plates 1 are received by the transport device 6 on plate holders 22 secured to timing chains 21 so that the printing plates 1 are removable from above. As a result, when in the position shown in FIGS. 1*a* and 2*a*, the upper edge of the flap 2' engages the underside of the printing plate 1, removing it from the transport device 6.

To ensure that the printing plate 1 remains vertical while being transported downward, so that its top does not fall forward, guide rails 25 associated with the frame 30 are provided with openings 23 connected to a vacuum pump 8. Alongside the openings 23, and arranged in a row, are strips 24 running at the same speed as the timing chains 21. The openings 23 are exposed between the strips 24. As a result, when the vacuum pump 8 is operated, the printing plates 1 are pressed flat against the strips 24, permitting the printing plates 1 to be moved downward along the guide rails 25 in their proper orientation, yet substantially without friction.

Figure 1B:
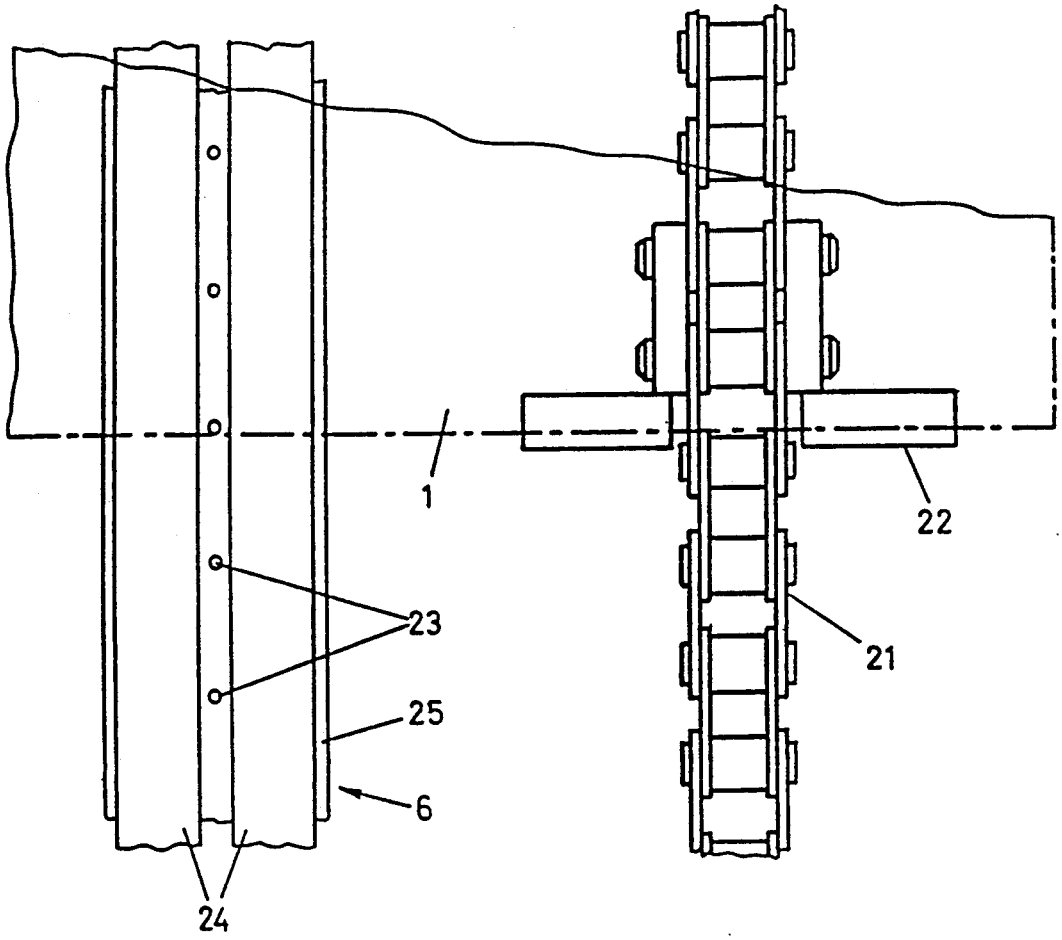
FIG. 1*b* is a partial, end view of the transport device for conveying the printing plates.
Figure 2B:
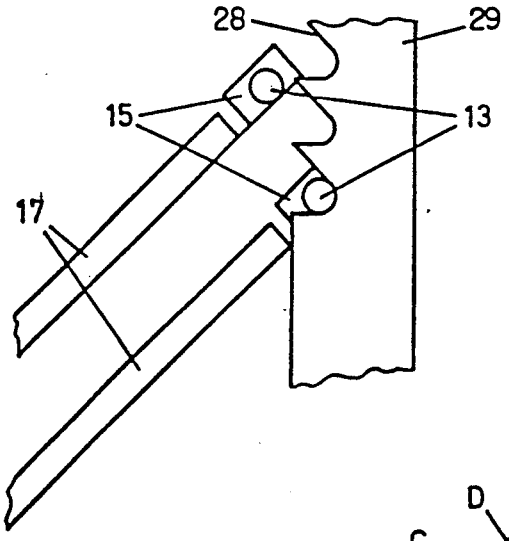
FIGS. 2*a*-2*c* are partial side elevational views of the shelves of the sorting device.
Figure 2A:
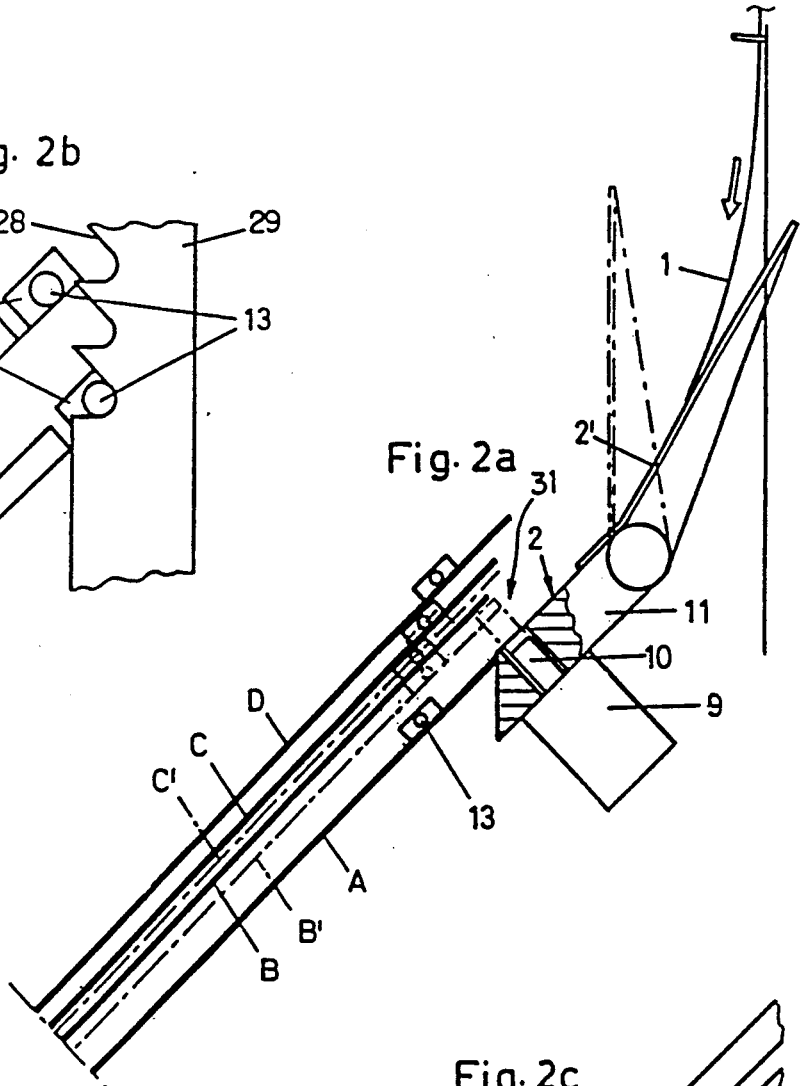
Figure 2C:
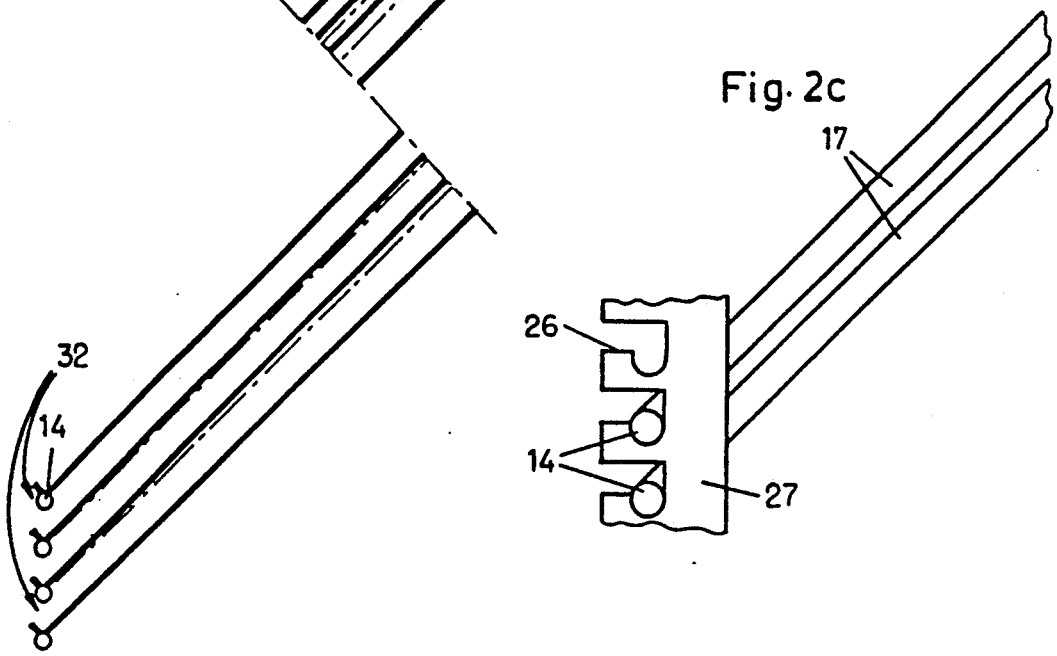

As soon as the lower edge of a printing plate 1 contacts the flap 2', the plate is lifted out of the plate holder 22 and, as shown in FIG. 1*a*, is diverted into the intended shelf 3 (thus separating from the strips 24). At approximately the same time, the corresponding insertion opening 31 is preferably enlarged, as is shown in FIGS. 2*a*-2*c*. To this end, each shelf 3 is pivotally mounted at its lower edge, by means of bearing pins 14, in cutouts 26 formed in a cooperating carrier 27. Attached at each upper edge of the shelf 3 are two more laterally projecting pins 13, which sit in cutouts 28 formed in yet other carriers 29. The sorting carriage 2 (or each sorting carriage) further includes a plate 11 which receives one or more tappets 10 for engaging the shelf 3. The tappet 10 is actuated, for example, by a pneumatic pressure cylinder 9.

In this fashion, the front of a shelf B, which lies above the adjacent shelf A to be occupied, is lifted shortly before the printing plate 1 is inserted. In this process the shelf B, and the spacers 15 which are attached to it, operate to push against the shelf C located above the shelf B, lifting this shelf as well, but through a smaller angle. The subsequent shelf D, however, generally need not be lifted. As soon as the printing plate 1 has been inserted into the shelf 3, the tappet 10 is returned to its original position and the shelves A through C are permitted to fall back to their original positions as a result of their own weight. The sorting carriage 2 can then be moved to another empty shelf, as desired.

Enlargement of the insertion opening makes it possible to space the shelves 3 at comparatively small distances from one another, in a space-saving manner, while still permitting the printing plates 1 to be introduced into a shelf 3 with relatively little deflection, or in the case of offset plates, with no deflection.

It is further possible to attach lips 17 and 18 to the shelves 3, to stiffen each shelf 3 and to reduce the amount of dust deposited on the printing plates 1 during their storage. To facilitate removal of the printing plates 1, each shelf 3 is further preferably provided with cutouts 20 on its lower edge. Raised lips 19 are also provided at the lower edge of each shelf 3 to prevent the printing plate 1 from falling from the extraction opening.

If a printing plate 1 passing a sorting carriage 2 is not to be transferred to an associated shelf 3, the flap 2' is withdrawn to the bypass position which is shown in phantom in FIG. 2*a*. This feature enables the sorting carriage to move bi-directionally, i.e., up or down, without interference. As a fail-safe feature, in the event that the sorting device malfunctions (e.g., as a result of a pneumatic or electronic fault), the flaps 2' are automatically set to the bypass position, and the printing plates 1 are guided by a fixed deflection panel 33 into an overflow bin 4.

Figure 4:
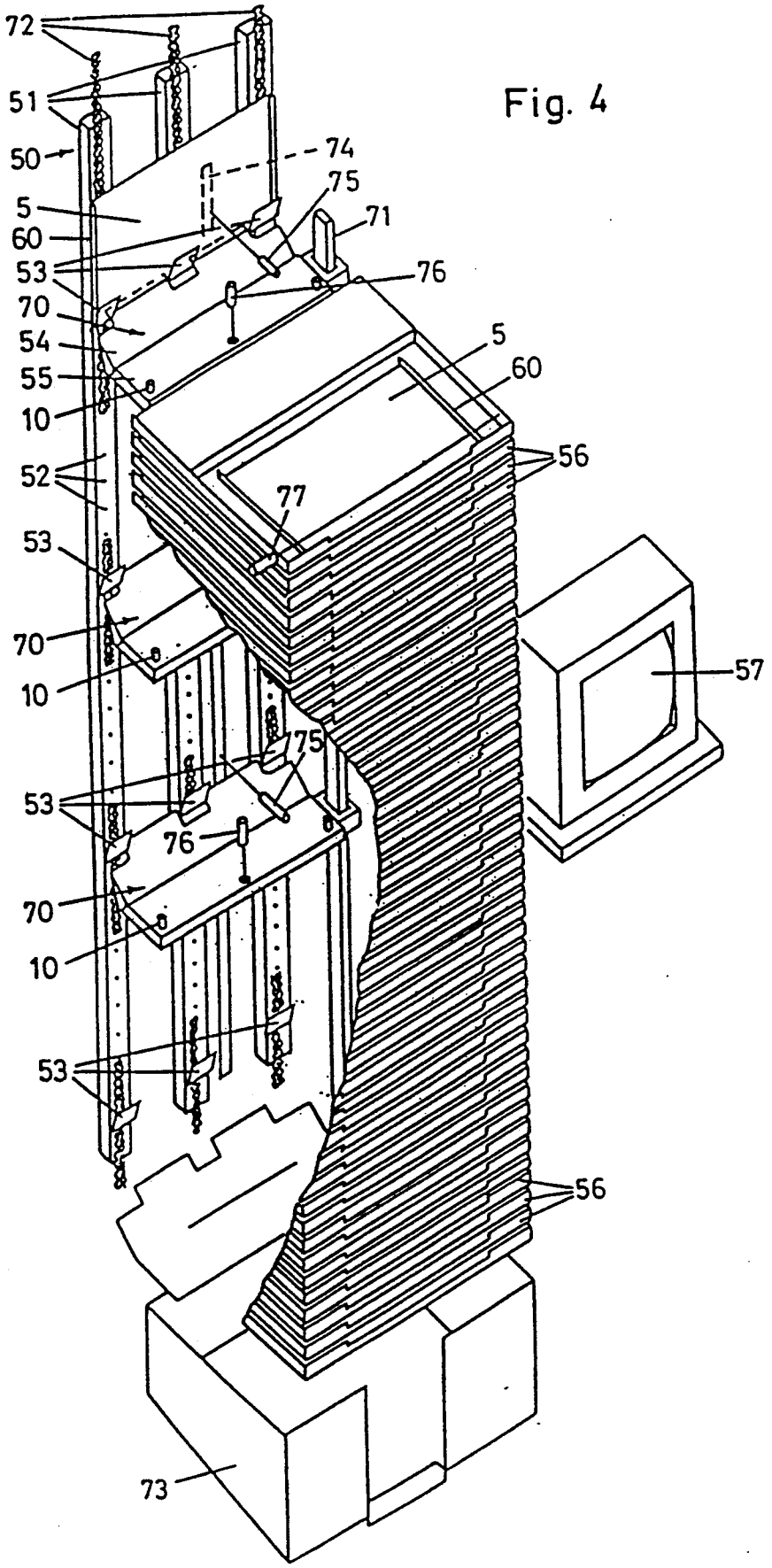
FIG. 4 is an isometric view of an alternative embodiment sorting device, with portions sectioned to reveal internal construction detail.

In the embodiment shown in FIG. 4, the printing plates 1 are stored in a series of shelves 56, as predetermined for each printing plate, by electronically controlled preselection. The electronic system recognizes empty shelves 56 and assigns the printing plates 1 to them. A monitor 57 indicates which printing plate 1 is located in which shelf 56. This makes it possible to store the printing plates 1 for a particular folding unit, in sorted order, before printing begins.

As FIG. 4 shows, the sorting device is equipped with three sorting carriages 70, which are moved along a guide 71, and which each serve fifteen shelves 56. The sorting carriages 70 are connected to one another, at a fixed distance from one another. Each sorting carriage 70 is fitted with a flap 54, which can again be moved into one of two positions. In the working position, the flap 54 is pivoted inward and lifts the arriving printing plate 1 out of the plate holders 53 (which are moved by a transport device 50 and attached to an endless drive chain 72). In the other position, the flap 54 is pivoted out of the way to allow the printing plate 1 to pass, such as when one of the three sorting carriages 70 is at a shelf 56 that is already occupied, or if an unidentified printing plate 1 must be passed to the overflow bin 73.

The drive chains 72 run in guide rails 51 which are further provided with nozzle openings 52 on their front side. The printing plates 1 are thus pulled against the rails 51 by a vacuum developed in the guide rails 51, to maintain the pressure plates 1 in a generally vertical orientation. Since the printing plates 1 are comparatively stiff (due to their folded edges), even a slight vacuum on the printing plates 1 is sufficient. The passage of a printing plate 1 is detected by a photoelectric device 75 which operates in conjunction with a reflective strip 74. Additional photoelectric devices 76 and 77 are used to detect the entry of a printing plate 1 into the shelves 56, and to determine which of the shelves 56 are occupied and which are empty.

Figure 3:
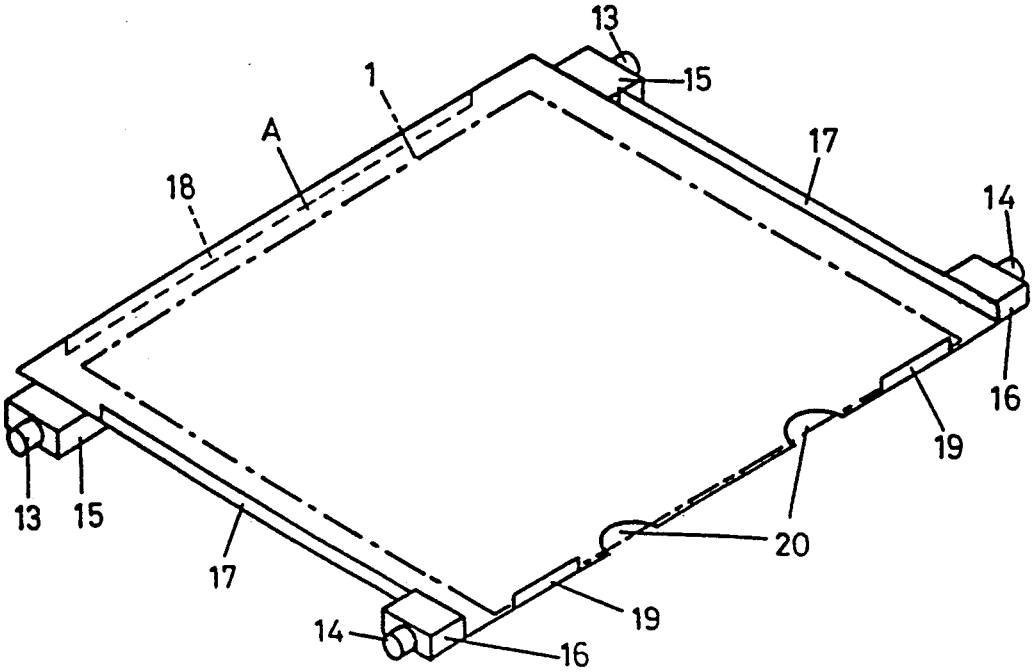
FIG. 3 is a perspective view of a shelf.

In this exemplary embodiment, the printing plates 1 shown are flexible plastic sheets known as "flexoplates". In such case, the drive chains 72 and the guide rails 51 can also be configured as shown in FIG. 1*b*, if desired. The shelves can also be made pivotable, as previously described, by providing each sorting carriage 70 with a device for pivoting the shelves. The embodiment shown in FIGS. 1-3 can also be provided with electronic detection devices similar to the photoelectric devices 75, 76, 77, and a monitor 57, if desired.

It will therefore be understood that various changes in the details, materials and arrangement of parts which have been herein described and illustrated in order to explain the nature of this invention may be made by those skilled in the art within the principle and scope of the invention as expressed in the following claims.

What is claimed is:

1. A method of sorting printing plates comprising:

continuously moving the printing on a vertically oriented transport device and into a predetermined position adjacent to an insertion opening of a sorting device having a plurality of vertically stacked, spaced, plate receiving shelves;

moving the printing plates on said transport device to a sorting carriage having a movable flap which, when in a first position, engages a printing plate and removes it from the transport device and which, when in a second position, bypasses the printing plates allowing the printing plates to continue along the transport device;

vertically moving said sorting carriage along said shelves to a position adjacent a predetermined shelf for storage of the plate;

positioning the movable flap in the first position when the sorting carriage arrives at the predetermined shelf transferring the plate to the sorting carriage; while substantially simultaneously, causing upward movement of a second shelf directly above the predetermined shelf onto which the plate is to be transferred by means attached to said sorting carriage, to widen the insertion opening; and transferrring the plate to the predetermined shelf through the widened insertion opening and then causing the second shelf to resume normal spacing with respect to the predetermined shelf.

2. The method of claim 11 wherein said plates are flexible printing plates for delivery to one or more folding units.

3. The method of claim 1 which further comprises the step of controlling movement of said sorting carriage along said shelves responsive to a control device.

4. The method of claim 1 wherein the transport device includes at least one, generally vertically oriented guide rail and at least one timing chain for receiving the printing plates, and wherein said method further comprises the step of pressing the printing plates flat against the guide rail while received by the timing chain.

5. The method of claim 1 wherein the transport device includes at least one, generally vertically oriented guide rail for receiving the printing plates, and wherein said method further comprises the step of supplying a vacuum to openings in said guide rail, generating a reduced pressure within the guide rail and pressing transported printing plates against the guide rail.

6. The method of claim 1 wherein the second shelf is moved upwardly without always having to lift all shelves above the predetermined shelf.

7. The method of claim 1 wherein the sorting carriage is bi-directionally movable along the shelves when the movable flap is in the second position.

* * * * *